US010272679B2

(12) United States Patent
Bruce et al.

(10) Patent No.: US 10,272,679 B2
(45) **Date of Patent: *Apr. 30, 2019**

(54) ELECTRICALLY CONNECTING ELECTRICALLY ISOLATED PRINTHEAD DIE GROUND NETWORKS AT FLEXIBLE CIRCUIT

(71) Applicant: Hewlett-Packard Development Company, L.P., Houston, TX (US)

(72) Inventors: Kevin Bruce, Vancouver, WA (US); Gregory N. Burton, Camas, WA (US); Joseph M. Torgerson, Philomath, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 157 days.

This patent is subject to a terminal disclaimer.

(21) Appl. No.: 15/275,916

(22) Filed: Sep. 26, 2016

(65) Prior Publication Data

US 2017/0015099 A1 Jan. 19, 2017

Related U.S. Application Data

(63) Continuation of application No. 12/742,287, filed as application No. PCT/US2007/086210 on Dec. 2, 2007, now Pat. No. 9,555,630.

(51) Int. Cl.
*B41J 2/14* (2006.01)
*B41J 2/16* (2006.01)

(52) U.S. Cl.
CPC ..... *B41J 2/14129* (2013.01); *B41J 2/1433* (2013.01); *B41J 2/14072* (2013.01); *B41J 2/1601* (2013.01); *B41J 2/1629* (2013.01); *B41J 2002/14491* (2013.01)

(58) Field of Classification Search
CPC .... B41J 2/14129; B41J 2/1433; B41J 2/1629; B41J 2/1601; B41J 2/14072; B41J 2002/14491
See application file for complete search history.

(56) References Cited

U.S. PATENT DOCUMENTS

| | | | |
|---|---|---|---|
| 5,159,353 | A | 10/1992 | Fasen et al. |
| 5,317,183 | A | 5/1994 | Hoffman et al. |
| 6,000,773 | A | 12/1999 | Murray et al. |
| 6,543,884 | B1 | 4/2003 | Kawamura et al. |
| 6,582,063 | B1 | 6/2003 | Chavarria et al. |
| 6,616,268 | B2 | 9/2003 | Parish |

(Continued)

FOREIGN PATENT DOCUMENTS

| | | |
|---|---|---|
| JP | 04-320851 | 11/1992 |
| JP | 06-069497 | 3/1994 |

(Continued)

*Primary Examiner* — Huan H Tran
(74) *Attorney, Agent, or Firm* — Michael A Dryja

(57) ABSTRACT

A printhead assembly for an inkjet-printing device includes a printhead die and a flexible circuit connected to the printhead die. The printhead die includes a substrate, a first ground network electrically connected to the substrate, a device layer, and a second ground network electrically connected to the device layer. The first ground network and the second ground network are electrically isolated from one another within the printhead die. The first ground network and the second ground network are electrically connected to one another at the flexible circuit.

16 Claims, 4 Drawing Sheets

(56) References Cited

U.S. PATENT DOCUMENTS

| | | | |
|---|---|---|---|
| 6,787,050 | B2 | 9/2004 | Parish |
| 6,977,185 | B2 | 12/2005 | Bryant et al. |
| 7,267,430 | B2 | 9/2007 | Parish |
| 7,808,092 | B2 | 10/2010 | Ho |
| 2002/0149632 | A1 | 10/2002 | Parish |
| 2003/0011658 | A1 | 1/2003 | Parish |
| 2003/0080362 | A1 | 5/2003 | Dodd et al. |
| 2006/0221141 | A1 | 10/2006 | Parish |

FOREIGN PATENT DOCUMENTS

| | | |
|---|---|---|
| JP | 09-094968 | 4/1997 |
| JP | 09-123450 | 5/1997 |
| JP | 2001-199092 | 7/2001 |
| JP | 2004-074505 | 3/2004 |
| JP | 2004-160829 | 3/2004 |
| JP | 2005-238843 | 9/2005 |
| JP | 2005-271446 | 10/2005 |
| JP | 2005-305966 | 11/2005 |
| JP | 2006-334889 | 12/2006 |
| JP | 2007-509782 | 4/2007 |
| JP | 2007-526143 | 9/2007 |

ELECTRICALLY CONNECTING ELECTRICALLY ISOLATED PRINTHEAD DIE GROUND NETWORKS AT FLEXIBLE CIRCUIT

BACKGROUND

Inkjet-printing devices operate by ejecting ink via a printhead die onto a medium like paper to form an image on the medium. The printhead die is a relatively small semiconductor part that typically has many intricate components which have to be precisely fabricated in order for the die to operate properly. Many printhead dies include a silicon substrate and a device layer over the substrate. The device layer may include transistors, a heating resistor, and other components to permit the die to operate properly.

In many types of printhead dies, the silicon substrate and the device layer are grounded together for optimal operation of the printhead dies. However, during fabrication of these printhead dies, the grounding together of the silicon substrate and the device layer can be problematic. In particular, fabrication processes involving etching of the silicon substrate may not be optimally performed where the silicon substrate and the device layer are grounded together.

DETAILED DESCRIPTION OF THE DRAWINGS

Figure 1:
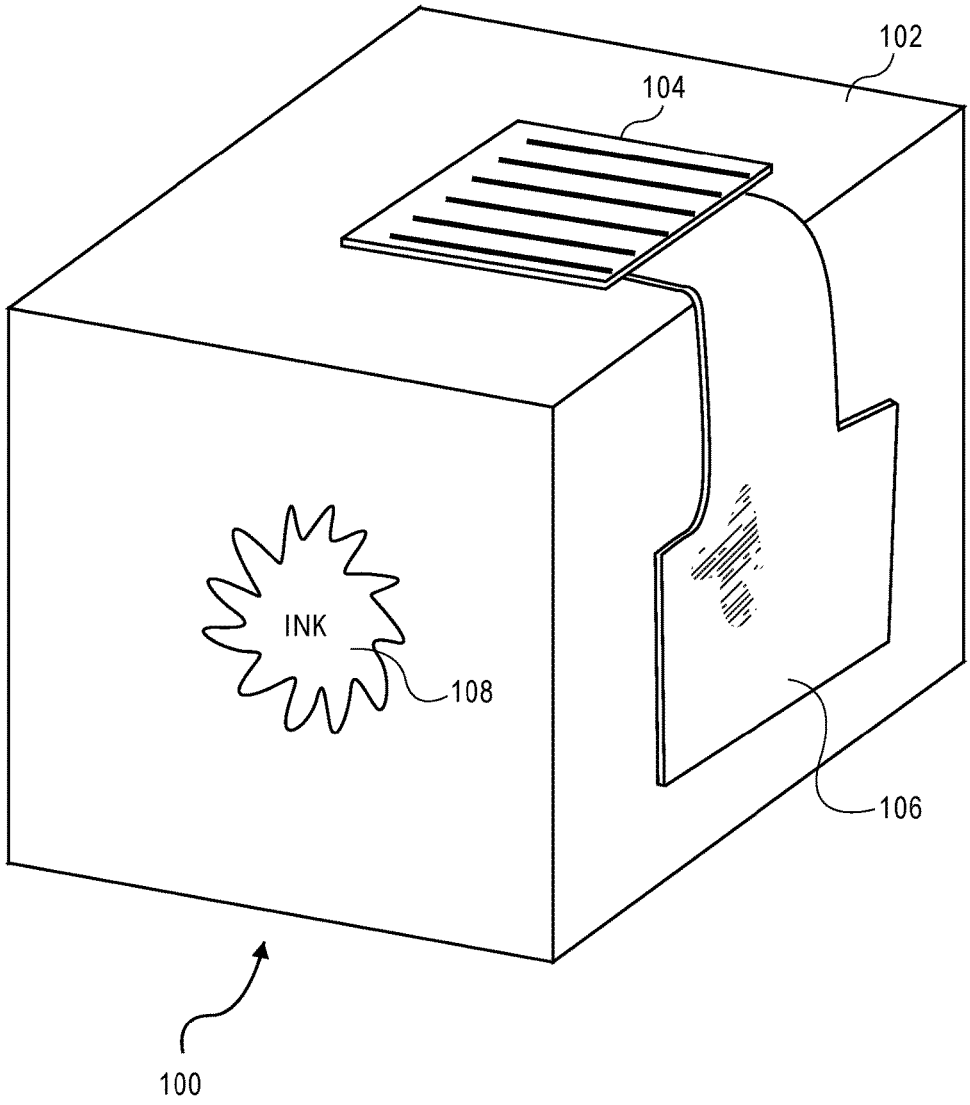
FIG. 1 is a diagram of a representative inkjet-printing device printhead assembly, according to an embodiment of the present disclosure.

FIG. 1 shows a representative inkjet-printing device printhead assembly 100, according to an embodiment of the present disclosure. The printhead assembly 100 includes an enclosure cartridge 102. The enclosure cartridge 102, and thus the printhead assembly 100, is insertable into a corresponding slot of an inkjet-printing device, so that the device can eject ink on a medium like paper to form an image on the medium.

The printhead assembly 100 includes a printhead die 104 that is electrically connected to a flexible circuit 106 of the assembly 100. The printhead die 104 is typically a small semiconductor die, which is depicted in FIG. 1 as being proportionally larger than it actually is in relation to the flexible circuit 106 and the enclosure cartridge 102 for illustrative clarity. The flexible circuit 106 electrically mates to a corresponding electrical connector of an inkjet-printing device upon the enclosure cartridge 102 being removably inserted or installed into the inkjet-printing device. The flexible circuit 106 specifically can include conductor traces from the printhead die 104 so that the die 104 can be electrically coupled to the inkjet-printing device. The circuit 106 is flexible so that it can bend around one or more edges of the enclosure cartridge 102, as depicted in FIG. 1.

In the embodiment of FIG. 1, the printhead assembly 100 also includes a supply of ink 108, which is contained within the interior of the enclosure cartridge 102. However, in another embodiment, the supply of ink 108 may be contained in an assembly that is separate from the printhead assembly 100. In general, the inkjet-printing device into which the printhead assembly 100 has been installed causes the printhead die 104 to eject droplets of the ink 108 through the die to form an image on a medium like paper.

Figure 2:
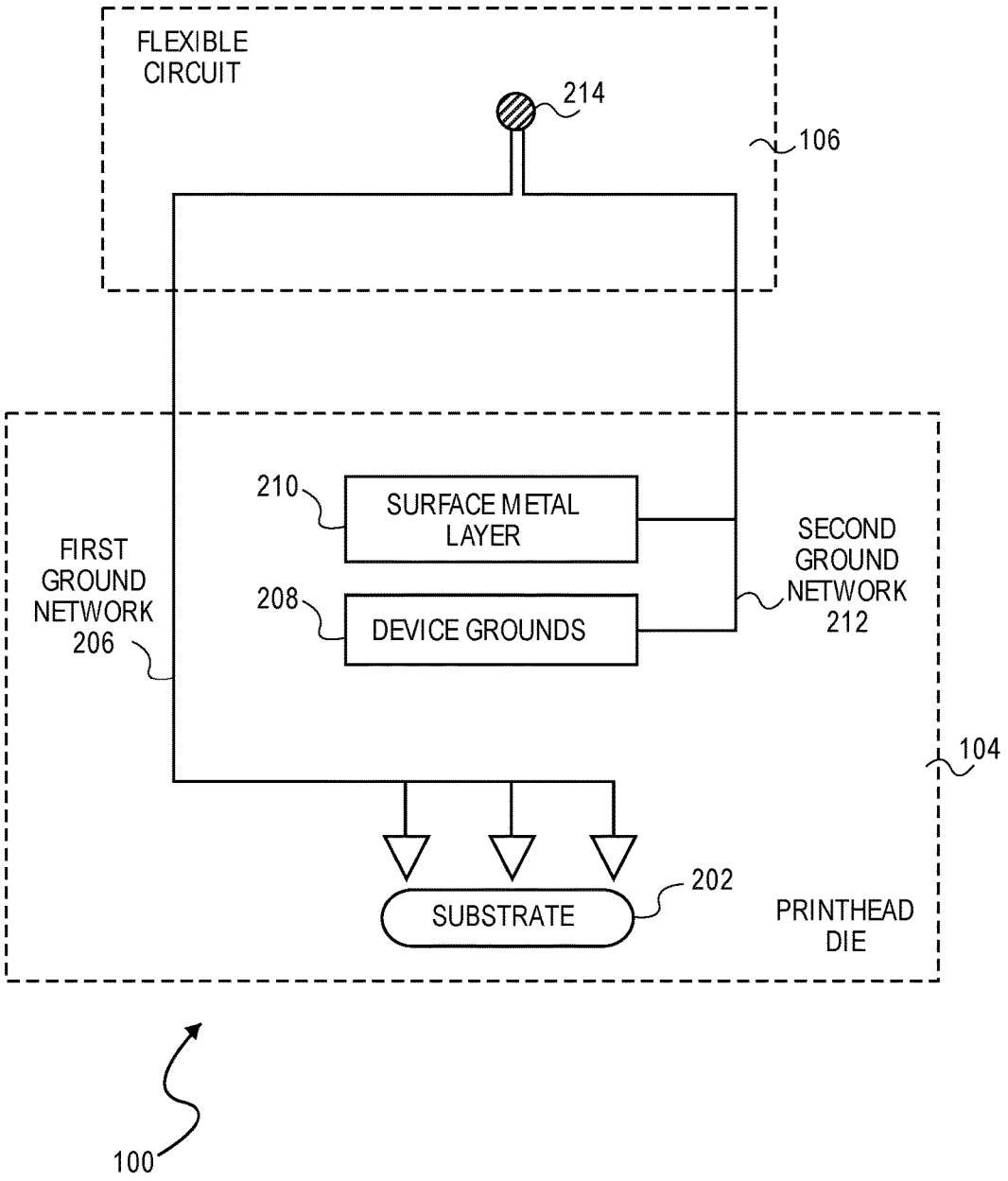
FIG. 2 is a diagram of an inkjet-printing device printhead assembly schematically showing a first ground network and a second ground network that are electrically isolated from one another within a printhead die, and that are electrically connected to one another at a flexible circuit, according to an embodiment of the present disclosure.

FIG. 2 shows a schematic view of a portion of the inkjet-printing device printhead assembly 100, according to an embodiment of the present disclosure. Specifically, the printhead die 104 and the flexible circuit 106 of the printhead assembly 100 are shown in FIG. 2. The printhead die 104 is depicted as including a substrate 202, such as a silicon substrate. The substrate 202 is the substrate of the printhead die 104 on which various devices, such as transistors and a heating resistor, of the die 104 are fabricated. The substrate 202 is electrically connected to what is referred to as a first ground network 206. That is, the first ground network 206 is electrically connected to a number of portions of the substrate 202.

The printhead die 104 is also depicted as including device grounds 208 and a surface metal layer 210. The device grounds 208 are the ground connections for the devices fabricated on the printhead die 104, such as the grounds of the various transistors that may be fabricated on the printhead die 104. The surface metal layer 210 may specifically be a layer of gold. The surface metal layer 210 in one embodiment provides a low-resistance conductor for power and ground signals within the printhead die 104. The device grounds 208 and the surface metal layer 210 are electrically connected to what is referred to as a second ground network 212.

The second ground network 212 can be considered a primary ground network, while the first ground network 206 can be considered a secondary or a "quiet" ground network, in that during operation of the printhead die 104, significantly more current flows through the second ground network 212 than through the first ground network 206. It is noted that within the printhead die 104 itself, the first ground network 206 and the second ground network 212 are electrically isolated from one another. This is advantageous, because in some processes employed during fabrication of the printhead die 104, such as etching, the second ground network 212 is desirably at a different electrical potential than the first ground network 206. As such, having the ground networks 206 and 212 electrically isolated from one another within the printhead die 104 is advantageous during fabrication of the die 104.

However, during operation of the printhead die 104, the first ground network 206 and the second ground network 212 are desirably both maintained at the same electrical potential, specifically common or ground, such as earth ground. The embodiment of FIG. 2 electrically connects the ground networks 206 and 212 with each other at the flexible circuit 106. Specifically, the ground networks 206 and 212 are shorted together at one or more points 214 within the flexible circuit 106. The points 214 may be implemented as an inkjet-printing device connector pin, for instance, that electrically connects the printhead die 104 to the inkjet-printing device in which the printhead assembly 100 is inserted or installed.

Thus, the embodiment of FIG. 2 provides for the at least substantially optimal electrical potentials at the ground networks 206 and 212 both during fabrication of the printhead die 104 and during operation of the printhead die 104. During fabrication of the printhead die 104, the ground networks 206 and 212 are electrically isolated, and therefore can be at different electrical potentials. During operation of the printhead die 104, the ground networks 206 and 212 are electrically connected with one another at the flexible circuit 106, and therefore are maintained at the same ground or common electrical potential.

Figure 3:
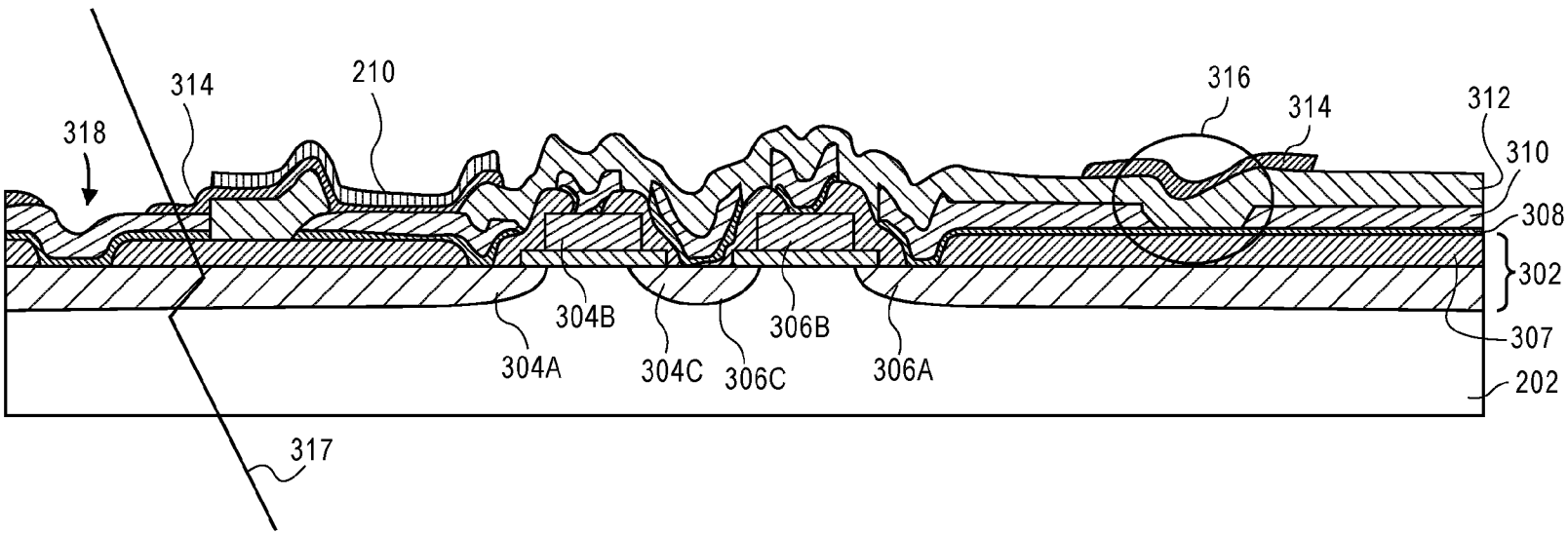
FIG. 3 is a cross-sectional diagram depicting the layers of an inkjet-printing device printhead die in detail, according to an embodiment of the present disclosure.

FIG. 3 shows a cross section of a portion of the printhead die 104, according to an embodiment of the invention. Disposed over the printhead die 104 is a device layer 302. The device layer 302 includes a number of thin-film transistors. For instance, one transistor includes a source 304A, a polysilicon gate 304B, and a drain 304C, where there is a small layer of gate oxide (which is not specifically called out in FIG. 3) between the gate 304B and the source 304A and the drain 304C. Another transistor includes a source 306A, a polysilicon gate 306B, and a drain 306C, where there is a small layer of gate oxide between the gate 306B and the source 306A and the drain 306C. The drain 304C is the same as the drain 306C.

The device layer 302 can also be said to include a heating resistor 316, although in FIG. 3 the heating resistor 316 is depicted as being over the demarcated device layer 302 for illustrative convenience. As can be appreciated by those of ordinary skill within the art, when current is provided to the heating resistor 316, the resistor 316 is said to be "fired." As such, the resistor 316 causes a bubble to form within ink situated on the top side of the printhead die 104. This bubble ejects a droplet of the ink from the die 104. Thereafter, the bubble collapses. The device layer 302 can further be said to include an insulating layer 307 in one embodiment, which may be phosphosilicate glass (PSG) in one embodiment.

Disposed over the device layer 302 is a thin resistive layer 308, over which a first metal layer 310 is disposed. The first metal layer 310 may, for instance, be aluminum and/or a tantalum-aluminum alloy, such that the layer 310 has two sub-layers, one of aluminum and one of a tantalum-aluminum alloy. Disposed over the first metal layer 310 is a passivation and/or insulating layer 312, which protects the printhead die 104 from the ink. The layer 312 may, for instance, be silicon carbide or silicon nitride. The heating resistor 316 can be said to include a portion of the insulating layer 307, a portion of the resistive layer 308, a portion of the first metal layer 310, a portion of the layer 312, and/or a portion of an additional protecting layer 314 disposed over the passivation layer 312.

Disposed over the device layer 302—specifically over the first metal layer 310—is the surface metal layer 210, which can be a sub-layer of a second metal layer that also includes a tantalum layer. The surface metal layer 210 is separated and electrically insulated from the first metal layer 310 by a portion of the layer 312. The surface metal layer 210 is electrically connected to the grounds of the transistors within the device layer 302, and may also be electrically connected to the main power ground as well as other grounds, for instance, although none of these electrical connections are visible in the cross-sectional profile of FIG. 3. However, the flexible circuit 106 of FIGS. 1 and 2 is electrically connected to the second ground network 212 of FIG. 2 via the surface metal layer 210. It can also be said that the second ground network 212 is implemented at the second metal layer that includes the surface metal layer 210. It can further be said that the second ground network 212 is not primarily implemented at the first metal layer 310.

A breakaway line 317 indicates that the portions to the left of the line 317 in FIG. 3 are located farther away on the printhead die 104 from the portions to the right of the line 317 in FIG. 3 than is specifically shown in FIG. 3. The portions to the left of the line 317 include a substrate contact 318. The contact 318 exposes a portion of the first metal layer 310, and there is none of the passivation layer 312, the protecting layer 314, and the insulating layer 307 at this location. The first metal layer 310 at the contact 318 thus electrically exposes the substrate 202, since the two layers above the substrate 202 at this location—the thin resistive layer 308 and the first metal layer 310—are both electrically conductive. The flexible circuit of FIGS. 1 and 2 is electrically connected to the first ground network 206 of FIG. 2 via the first metal layer 310. It can also be said that the first ground network 206 is primarily implemented at the first metal layer 310.

Therefore, FIG. 3 shows how the ground networks 206 and 212 of FIG. 2 are electrically isolated from one another within the printhead die 104 itself. The surface metal layer 210, for instance, is electrically isolated from the portion of the first metal layer 310 at which the contact 318 is located. As such, insofar as the second ground network 212 is implemented at the second metal layer that includes the surface metal layer 210, and the first ground network 206 is primarily implemented at the first metal layer 310, the ground networks 206 and 212 are electrically isolated from one another within the printhead die 104 itself.

Figure 4:
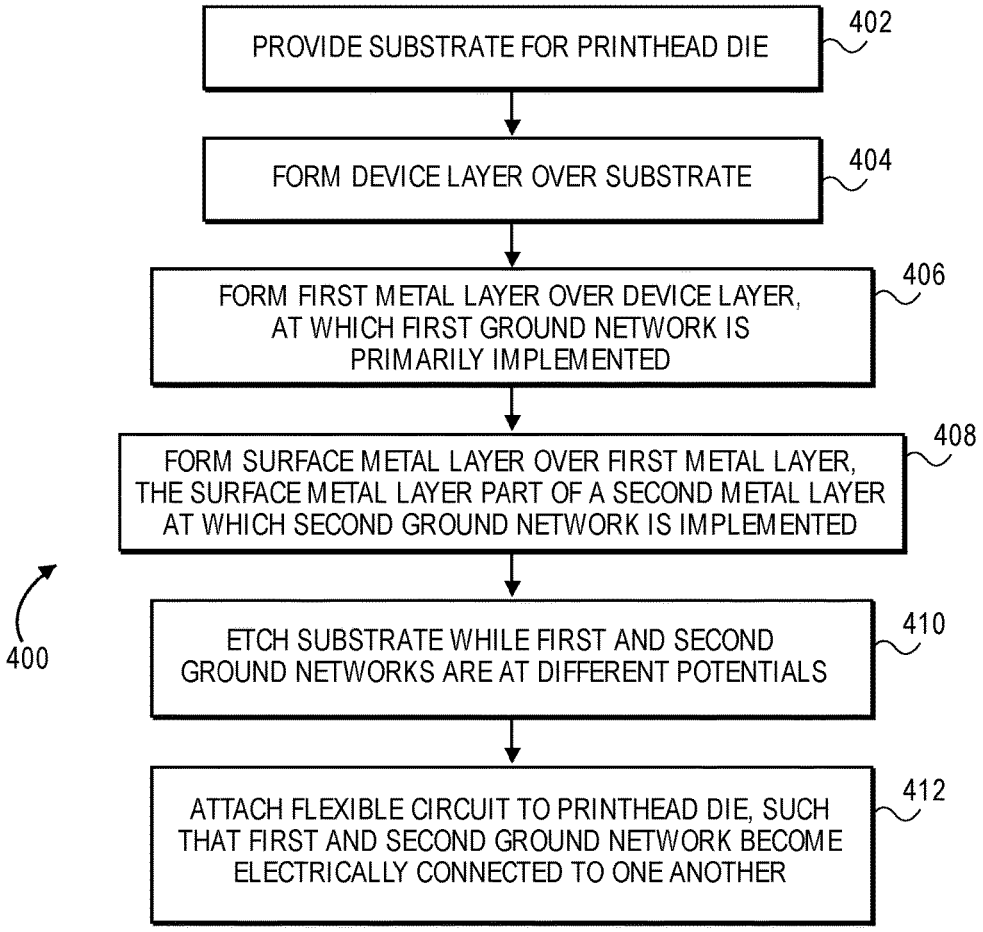
FIG. 4 is a flowchart of a method for at least partially fabricating an inkjet-printing device printhead assembly, according to an embodiment of the present disclosure.

FIG. 4 shows a method 400 for at least partially fabricating the inkjet-printing device printhead assembly 100, according to an embodiment of the present disclosure. It is noted that just some parts of the fabrication process are particularly depicted in FIG. 4 and described herein. Those of ordinary skill within the art can thus appreciate that other parts may be performed to complete the fabrication of the printhead assembly 100. In particular, just the parts relevant to embodiments of the present disclosure are depicted in FIG. 4 and described herein.

The substrate 202 for the printhead die 104 of the printhead assembly 100 is provided (402). Thereafter, the device layer 302, including the thin-film transistors and/or the heating resistor 316, may be formed over the substrate (404). The first metal layer 310 at some time thereafter is formed over the device layer 302 (406), where the first ground network 206 is primarily implemented at the first metal layer 310 as has been described. Ultimately, the surface metal layer 210 is formed over the first metal layer 310 (408), where the second ground network 212 is implemented at the second metal layer that includes the surface metal layer 210 as has been described.

The substrate 202 can be etched such that the first ground network 206 and the second ground network 212 are at different potentials (410). For instance, the substrate 202 may be wet-etched using tetramethylammonium hydroxide (TMAH). It has been found that TMAH etching the substrate 202 is optimally performed when the surface metal layer 210 (i.e., the second ground network 212) is at a potential in relation to the substrate 202 (i.e., the first ground network 206). Otherwise, the substrate 202 may be etched improperly. The substrate 202 may be etched to create a hole for feeding ink through the printhead die 104, and/or to create a clean and smooth edge near the heating resistor 316, as can be appreciated by those of ordinary skill within the art. Embodiments of the invention permit the surface metal layer 210 to be at a potential in relation to the substrate 202, insofar as the substrate 202 and the surface metal layer 210 (i.e., the first ground network 206 and the second ground network 212) are electrically isolated from one another within the printhead die 104 itself, prior to the flexible circuit 106 being attached to the die 104.

Once etching has been completed, the flexible circuit 106 may be connected to the printhead die 104 (412), such that the first ground network 206 and the second ground network 212 become electrically connected to one another. As such, when the printhead assembly 100 is being used, the ground networks 206 and 212 (i.e., the surface metal layer 210 and the substrate 202 or the first metal layer 310) can be maintained at the same ground or other common potential, which has been found to result in optimal operation of the assembly 100. Thus, during usage of the printhead assembly 100, the ground networks 206 and 212 remain electrically connected to one another due to their being electrically connected to each other at the flexible circuit 106.

Figure 5:
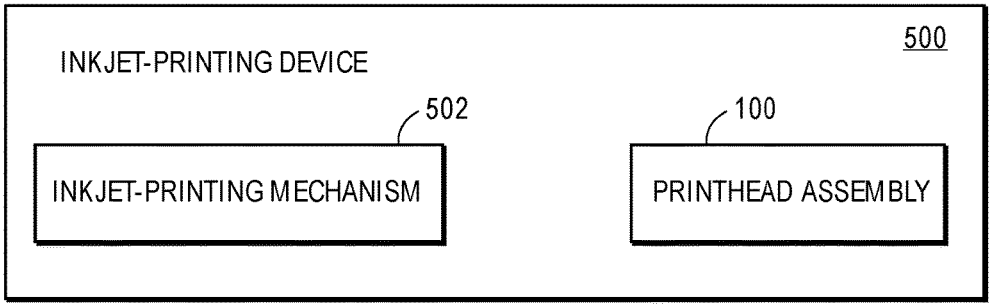
FIG. 5 is a block diagram of a rudimentary inkjet-printing device, according to an embodiment of the present disclosure.

In conclusion, FIG. 5 shows a rudimentary inkjet-printing device 500, according to an embodiment of the present disclosure. The inkjet-printing device 500 may be an inkjet printer, or a multifunction device (MFD) or an all-in-one (AIO) that can include other functionality in addition to inkjet-printing functionality. The inkjet-printing device 500 is depicted in FIG. 5 as including the printhead assembly 100 that has been described and an inkjet-printing mechanism 502. Those of ordinary skill within the art can appreciate that the inkjet-printing device 500 can and typically will include other components, in addition to those depicted in FIG. 5.

The inkjet-printing mechanism 502 includes those components by which the inkjet-printing device 500 forms images on media such as paper by, for instance, thermally ejecting ink onto the media. The printhead assembly 100 may thus share components with the inkjet-printing mechanism 502. That is, the printhead assembly 100 includes the printhead die 104 that actually causes ink to be ejected. To this extent, the inkjet-printing mechanism 502 can be said to share the printhead die 104 with the printhead assembly 100. Other components that the inkjet-printing mechanism 502 can include are firmware, media advancement motors, and so on, as can be appreciated by those of ordinary skill within the art.

We claim:

1. A printhead assembly for an inkjet-printing device, comprising:

a printhead die comprising:

a substrate;

a metal layer primarily implementing a first ground network electrically connected to the substrate;

a device layer;

a surface metal layer, different than the metal layer, implementing a second ground network electrically connected to the device layer, the second ground network electrically isolated from the first ground network within the printhead die itself such that the surface metal layer and the device layer are electrically disconnected from the metal layer and the substrate within the printhead die itself; and, a flexible circuit connected to the printhead die, wherein the first ground network and the second ground network are electrically connected to one another just by the flexible circuit.

2. The printhead assembly of claim 1, wherein during fabrication of the printhead die, the first ground network is temporarily at a different electrical potential than the second ground network.

3. The printhead assembly of claim 2, wherein the first ground network is temporarily at a different electrical potential than the second ground network during etching of the substrate.

4. The printhead assembly of claim 1, wherein the metal layer is one or more of a tantalum-aluminum alloy layer and an aluminum layer.

5. The printhead assembly of claim 1, wherein the surface metal layer comprises a gold layer.

6. The printhead assembly of claim 1, wherein the substrate is a silicon substrate.

7. The printhead assembly of claim 1, wherein the device layer comprises one or more transistors, and a heating resistor to cause ink to be ejected from the printhead assembly.

8. The printhead assembly of claim 1, wherein the flexible circuit electrically connects the printhead die to the inkjet-printing device.

9. A printhead assembly for an inkjet-printing device, comprising:

a printhead die comprising:

a substrate;

a metal layer primarily implementing a first ground network electrically connected to the substrate;

a device layer;

a surface metal layer, different than the metal layer, implementing a second ground network electrically connected to the device layer, the second ground network physically independent from the first ground network within the printhead die itself such that the surface metal layer and the device layer are electrically disconnected from the metal layer and the substrate within the printhead die itself; and, a flexible circuit connected to the printhead die, wherein the first ground network and the second ground network are electrically connected to one another just by the flexible circuit.

10. The printhead assembly of claim 9, wherein during fabrication of the printhead die, the first ground network is temporarily at a different electrical potential than the second ground network.

11. The printhead assembly of claim 10, wherein the first ground network is temporarily at a different electrical potential than the second ground network during etching of the substrate.

12. The printhead assembly of claim 9, wherein the metal layer is one or more of a tantalum-aluminum alloy layer and an aluminum layer.

13. The printhead assembly of claim 9, wherein the surface metal layer comprises a gold layer.

14. The printhead assembly of claim 9, wherein the substrate is a silicon substrate.

15. The printhead assembly of claim 9, wherein the device layer comprises one or more transistors, and a heating resistor to cause ink to be ejected from the printhead assembly.

16. The printhead assembly of claim 9, wherein the flexible circuit electrically connects the printhead die to the inkjet-printing device.

* * * * *